US005947579A

United States Patent [19]

Horton et al.

[11] Patent Number: 5,947,579

[45] Date of Patent: Sep. 7, 1999

[54] UNDERWATER CHEMILUMINESCENT DIVING LIGHT

[75] Inventors: John D. Horton, Panama City; Robert Woodall, Lynn Haven; Felipe Garcia, Panama City, all of Fla.

[73] Assignee: The United States of America as represented by the Secretary of the Navy, Washington, D.C.

[21] Appl. No.: 08/903,031

[22] Filed: Jul. 29, 1997

[51] Int. Cl.[6] ..... F21K 2/00

[52] U.S. Cl. ..... 362/34; 362/223; 362/267; 362/101

[58] Field of Search ..... 362/267, 101, 362/294, 223, 84, 34

[56] References Cited

U.S. PATENT DOCUMENTS

| | | | |
|---|---|---|---|
| 3,884,560 | 5/1975 | Neylan | 362/34 |
| 4,405,973 | 9/1983 | Moscarillo | 362/34 |
| 4,712,165 | 12/1987 | Cetrone | 362/147 |
| 4,771,299 | 9/1988 | Gell | 354/64 |
| 4,931,910 | 6/1990 | Wills | 362/34 |
| 5,083,242 | 1/1992 | Piotrowski | 362/34 |
| 5,735,595 | 4/1998 | Nederpel | 362/223 |

*Primary Examiner*—Sandra O'Shea
*Assistant Examiner*—Marshall Honeyman
*Attorney, Agent, or Firm*—Harvey A. Gilbert; Donald G. Peck

[57] ABSTRACT

A lighting device has light stick(s) housed in a hand-held receptacle. The internal surface areas of the hand-held receptacle are reflective. An opening is formed in the hand-held receptacle such that illumination generated by the light stick(s) is transmitted via the opening. The device can be made entirely of non-magnetic materials for use in clandestine underwater operations. The opening can be sealed with an optically transparent cover. Valves can be included to provide an air-filled or evacuated medium surrounding the light stick(s).

27 Claims, 2 Drawing Sheets

UNDERWATER CHEMILUMINESCENT DIVING LIGHT

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to lighting devices, and more particularly to a simple lighting device suitable for underwater use by divers especially in clandestine underwater operations or where low/non-magnetic signature is required.

BACKGROUND OF THE INVENTION

In underwater diving activities of a military, commercial or sporting nature, divers often illuminate their way through the use of flashlights or chemically reactive light sticks. In order to operate underwater, flashlights must be well-sealed and typically are rather heavy due to the weight of the power source. Further, in terms of military diving activities, flashlights are constructed at least partially from magnetic material which can be detected by underwater magnetic sensors. To overcome these problems, chemically-reactive light sticks are often used.

Light sticks are generally constructed of elastic, light-transmissive cylinders that house chemicals which, when allowed to react with one another, generate illumination. Such light sticks are available commercially. Unfortunately, while solving the weight and magnetic signature problems associated with flashlights, light sticks introduce new hazards for divers. For example, since light quickly diverges underwater, the radial emission of light from an activated light stick quickly dissipates thereby reducing the light stick's efficiency. Further, the 360° of radial illumination of a light stick can reduce a diver's visual acuity since some of the illumination is directed back to the diver's eyes. At the same time, illumination in all directions means that the diver's presence can be visually detected from a broad range of areas. This can present a problem in the case of clandestine diving activities.

SUMMARY OF THE INVENTION

Accordingly, it is an object of the present invention to provide a lighting device for underwater use.

Another object of the present invention is to provide a lighting device that presents no magnetic signature.

Still another object of the present invention is to provide a lighting device that makes efficient use of the generated illumination.

Yet another object of the present invention is to provide a lightweight, neutrally or slightly negatively buoyant lighting device.

A further object of the present invention is to provide a lighting device that is of simple and inexpensive construction.

Other objects and advantages of the present invention will become more obvious hereinafter in the specification and drawings.

In accordance with the present invention, a lighting device uses at least one light-transmissive receptacle containing chemicals that generate illumination upon initiation of a reaction within the light-transmissive receptacle. A hand-held receptacle supporting the light-transmissive receptacle has an internal surface area that is reflective. An opening is formed in the hand-held receptacle. When the light-transmissive receptacle is initiated and supported in the hand-held receptacle, illumination is transmitted therefrom via the opening. The device can be made entirely of non-magnetic and non-conducting materials for use in clandestine underwater operations. The opening can be sealed with an optically transparent cover. Valves can be provided to purge the interior of the hand-held receptacle of any water in order to provide an air-filled or evacuated medium surrounding the light-transmissive receptacle(s).

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
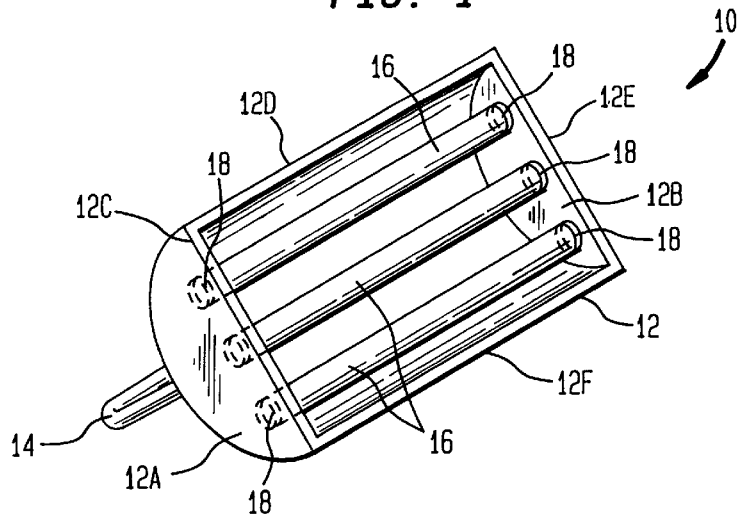
FIG. 1 is a perspective view of one embodiment of the lighting device according to the present invention.

Referring now to the drawings, and more particularly to FIG. 1, one embodiment of the lighting device according to the present invention is shown and is referenced generally by numeral 10. Lighting device 10 includes a housing or receptacle 12 which, for purposes of clandestine underwater activities, is made from a non-magnetic material such as a plastic or non-conducting composite material. Receptacle 12 can be constructed from component parts or molded as in integral unit in accordance with methods understood by one of ordinary skill in the art. To facilitate handling by a user, a handle 14 is typically attached to or formed integrally with receptacle 12. Handle 14 would also be made from a non-magnetic material if lighting device 10 were to be used in clandestine underwater activities.

As will be explained further below, the particular shape of receptacle 12 can vary. For the illustrated embodiment, the longitudinal portion of receptacle 12 is approximately one-half of a circular (as shown) or other parabolic cylinder. End caps 12A and 12B seal each axial end of receptacle 12 with resulting coplanar edges 12C, 12D, 12E and 12F defining an opening of receptacle 12. The internal surface area 12I of receptacle 12 should be reflective. One way of providing reflective surface areas is to apply, e.g., paint, the internal surface area of receptacle 12 with a reflective coating such as white or silver paint. A white reflective surface provides a matted reflection (i.e., an even flow of light) while a silver reflective surface provides a spectacular reflection (i.e., reflection that tends to be focused to a point or line). Any such coating should be non-magnetic if lighting device 10 is to be used in clandestine underwater activities. For simplicity of design, low-cost construction and low overall device weight, receptacle 12 can be constructed from polyvinyl chloride (PVC). If receptacle 12 is to be formed as a circular cylinder, standard PVC plumbing and pipe accessories can be used to construct receptacle 12 and handle 14. Further, if the PVC is already white in color, no additional reflective coating need be applied to the internal surface areas 12I of receptacle 12.

Supported by and within receptacle 12 are one or more (three are shown in FIG. 1) chemically reactive light sticks 16. The particular type, shape, size and/or color of illumination of each light stick 16 is not a limitation in the present invention. By way of example, each light stick 16 is an elastic light-transmissive cylinder that houses chemicals which, when allowed to react, generate illumination that is transmitted radially from each light stick 16. One such light stick is available commercially from Omniglow Corporation, Novato, Calif.

Once the required chemical reaction for illumination has been initiated, each light stick 16 is positioned such that its longitudinal axis is parallel to the longitudinal axis of receptacle 12 as shown. Support for each light stick 16 can be provided by means of circular recesses 18 formed in end caps 12A and 12B. Another option is to provide C-shaped protuberances or sockets on end caps 12A and 12B to achieve a snap-fit with the end of light stick 16. Numerous other means of supporting light sticks 16 in receptacle 12 can be used without departing from the scope of the present invention.

In operation, a user bends, twists or otherwise manipulates light stick 16 in a prescribed fashion to initiate the chemical reaction that generates illumination. The elastic nature of each light stick 16 allows the user to then manipulate the illuminating light stick 16 into recesses 18 of end caps 12A and 12B. Since light sticks 16 are positioned parallel to the longitudinal axis of receptacle 12 as described above, substantially all of the radially transmitted illumination is projected out of the opening defined by edges 12C–12F as will be explained further below.

As mentioned above, lighting device 10 can be used in or out of water. Naturally, in a water environment, each light stick 16 in the embodiment shown in FIG. 1 is surrounded by water. Since water causes light to quickly diverge, illumination efficiency (i.e., the amount of illumination produced by light stick(s) 16 relative to the amount of illumination exiting the opening defined by edges 12C–12F) could be improved if a greater amount of the radially transmitted illumination from each light stick 16 could reach and be reflected from the reflective internal surface areas of receptacle 12. In this way, a greater amount of illumination could be transmitted from receptacle 12. Improved illumination efficiency could also be used to reduce the number of light sticks 16 required.

Figure 2:
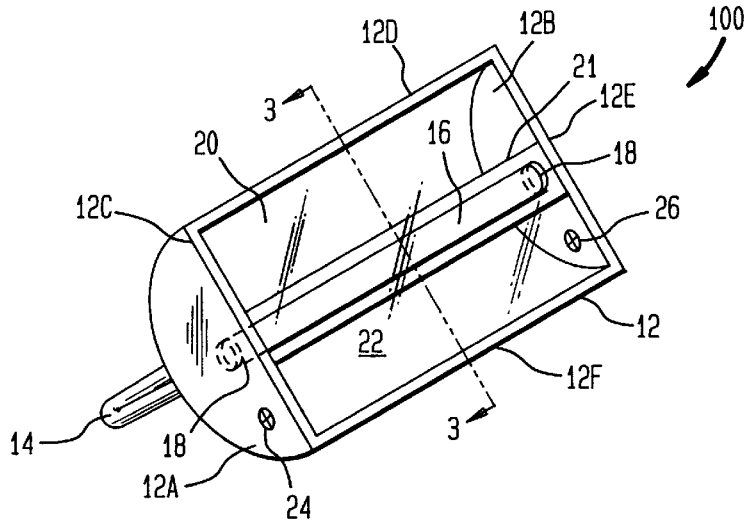
FIG. 2 is a perspective view of another embodiment of the present invention in which a sealed chamber is provided about the light stick(s)

To achieve improved illumination efficiency for underwater applications, a lighting device 100 (FIG. 2) could be used. Lighting device 100 can make use of the same receptacle 12, handle 14, light stick(s) 16 (only one is shown in FIG. 2) and recesses 18 as described above with respect to lighting device 10. In addition, lighting device 100 includes an optically transparent cover 20 that forms a water-tight seal with receptacle 12 along edges 12C–12F. As a result, a sealed chamber 22 is formed between receptacle 12 and cover 20. Means (not shown) can be provided to allow cover 20 to be removed to facilitate installation/removal of light stick 16. Cover 20 can accordingly be hinged to receptacle 12 and sealed thereto using one or more latches (not shown) in ways that would be well understood by one of ordinary skill in the art. Cover 20 could incorporate an optical element 21 (e.g., lens, mirror, etc.) to enhance and/or modify paths of illumination exiting lighting device 100. For example, if optical element 21 is a lens, as indicated in FIG. 2 light stick 16 is positioned at the focal plane of such lens to provide more directed or focused light transmission. If optical element 21 is a (concave) mirror, as illustrated in FIGS. 3A and 3B divergent light rays radiating from the object side of light stick 16 can be reflected back into sealed chamber 22 where they are reflected from the internal surface areas of receptacle 12.

Figure 3A:
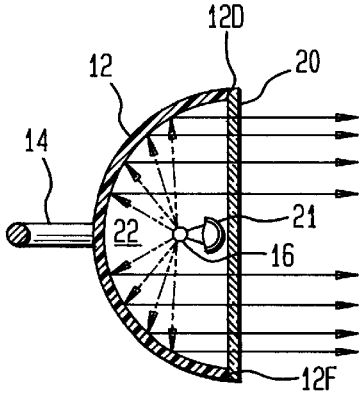
FIG. 3A is an axial cross-sectional view of the lighting device taken along line 3—3 in FIG. 2 that schematically illustrates parallel rays of illumination that can be produced by the lighting device.
Figure 3B:
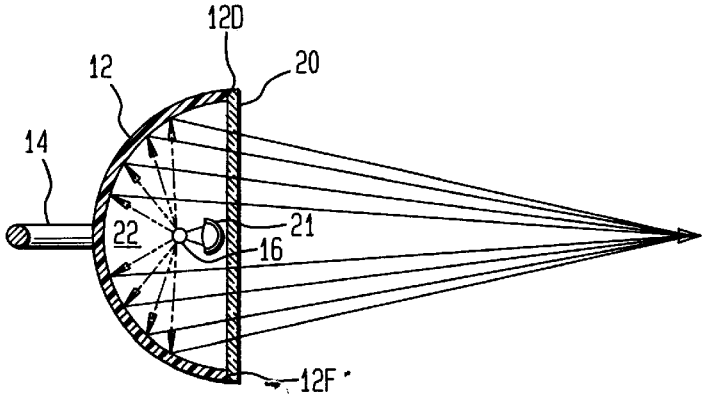
FIG. 3B is an axial cross-sectional view of the lighting device taken along line 3—3 in FIG. 2 that schematically illustrates converging rays of illumination that can be produced by the lighting device.

Path control of light rays exiting lighting device 100 is best understood by examining FIGS. 3A and 3B where an axial cross-sectional view of lighting device 100 is shown. The optics of lighting device 100 can be designed to produce an output of parallel light rays (FIG. 3A) or converging light rays (FIG. 3B). Both types of output are advantageous relative to countering the scattering of light as it passes through seawater. The internal surface areas of receptacle 12 can also be coated to produce divergent rays or a wider output beam.

In each case, direct illumination from light stick 16 is illustrated with dashed lines while device-reflected illumination transmitted out of receptacle 12 is illustrated with solid lines. In FIGS. 3A and 3B, it is assumed that optical element 21 is a mirror. The combination of mirror 21 and the circular (or otherwise parabolic) shape of the longitudinal portion of receptacle 12 causes substantially all of the radially transmitted illumination from light stick 16 to be reflected and directed in the same direction out of the opening defined by edges 12C–12F. In the FIG. 3A embodiment, the combination of mirror 21 and internal surface areas of receptacle 12 are configured to produce a beam of parallel light rays. In the FIG. 3B embodiment, the combination of mirror 21 and internal surface areas of receptacle 12 are configured to produce converging light rays. Note that a small hole (not shown) could also be provided in mirror 21 to allow parallel rays radiating from the object side of light stick 16 to pass therethrough without redirection. By placing handle 14 opposite such opening, illumination in either case is directed forward of a user's hand and can therefore be easily directed or focused to a desired area.

FIGS. 3A and 3B illustrate how light can be optically manipulated in the present invention. As would be well understood by those of ordinary skill in the art in the field of optics, the elements and their relationships in the present invention (i.e., curvature of receptacle 12, characteristics of optical element 21, distance between light stick 16 and receptacle 12 and optical element 21, etc.) can be used to customize the output of the lighting device.

Included in the walls of receptacle 12 (or, alternatively, through cover 20) are check valves 24 and 26. Check valve 24 is configured to receive pressurized air (or other gas) therethrough for admittance into sealed chamber 22. Conversely, check valve 26 is configured to allow the expulsion of fluid (e.g., water) from sealed chamber 22. In operation of lighting device 100 underwater, cover 20 is opened and an initiated light stick 16 is installed in receptacle 12. Once cover 20 is again in its sealed position, the user (i.e., a diver) supplies pressurized air (or other gas) to sealed chamber 22 via check valve 24 thereby causing water to be expelled from sealed chamber 22 via check valve 26. Pressurized air can be supplied by the user's expelled breathing air or by using inflation pressure from the diver's apparatus (e.g., air tank, buoyancy compensator, etc.). As a result, sealed chamber 22 becomes substantially air-filled. The air medium provides for more efficient transfer of illumination within sealed chamber 22 relative to a water-filled chamber 22. Therefore, illumination efficiency of lighting device 100 is improved relative to lighting device 10 when used in an underwater environment.

Figure 4:
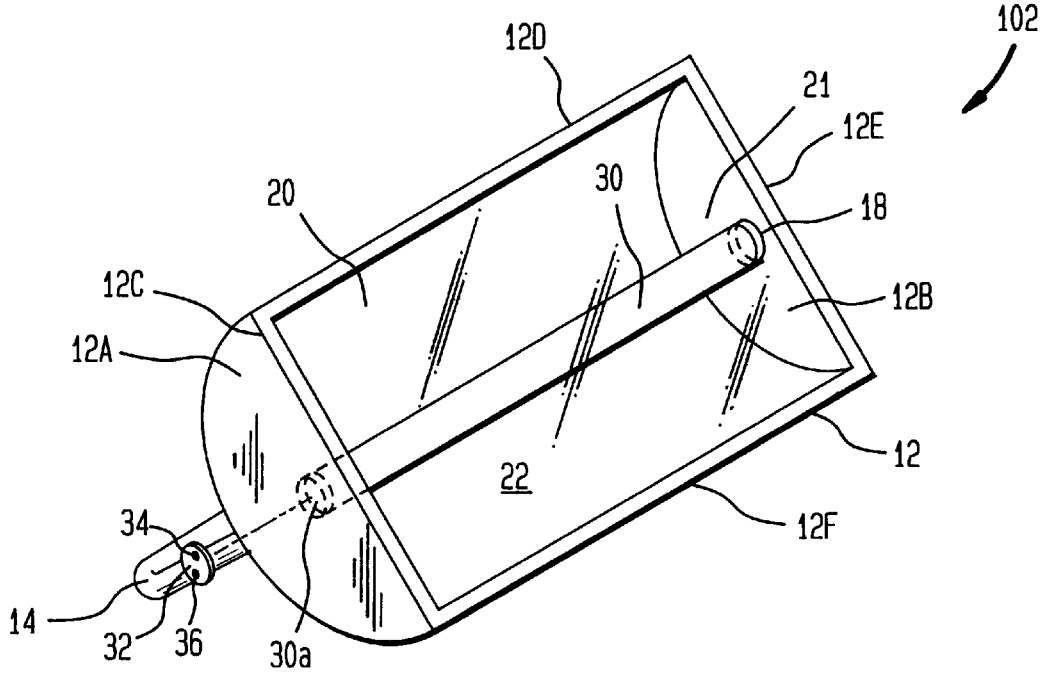
FIG. 4 is a perspective view of still another embodiment of the present invention in which the sealed chamber can be evacuated to further improve illumination efficiency when used in water.

To further improve illumination efficiency in an underwater environment, the present invention can be constructed as shown in FIG. 4 where lighting device 102 is similar to lighting device 100 with respect to those elements having the same reference numerals. However, cover 20 (with or without the incorporation of an optical lens) is permanently sealed at edges 12C–12F. A transparent (cylindrical) receptacle 30 for housing one or more light sticks (not shown) is supported at end caps 12A and 12B within receptacle 12. The interior of transparent receptacle 30 is sealed with respect to sealed chamber 22.

During construction of lighting device 102, sealed chamber 22 is placed in a vacuum state in accordance with ways understood by one of ordinary skill in the art. Alteratively, a check valve (not shown) could be provided through receptacle 12 or cover 20 to allow a vacuum state to be created prior to use. Transparent receptacle 30 is accessible at end 30A from the exterior of receptacle 12 to allow the insertion of a light stick. A cap 32 (shown detached) is provided to seal end 30A once the light stick is in transparent receptacle 30. Check valves 34 and 36 similar to check valves 24 and 26, respectively can be provided to cooperate between the exterior of receptacle 12 and transparent receptacle 30. For example, check valves 34 and 36 can be provided in cap 32. Operation and function of check valves 34 and 36 is the same as that of check valves 24 and 26, i.e., purge transparent receptacle 30 of any water after the insertion of a new light stick. Since transparent receptacle 30 presents a much smaller volume to be purged relative to sealed chamber 22, lighting device 102 can be quickly readied after a light stick change. As a result of such construction, lighting device 102 has improved illumination efficiency with respect to lighting device 100 when used in a water environment because the vacuum in sealed chamber 22 provides the best medium for transmission of illumination therein.

The advantages of the present invention are numerous. A simple lightweight, low-cost, efficient lighting device is presented for use in or out of water. The device can be made of non-magnetic materials for clandestine underwater operations. Light sticks of varying color can be used to allow the lighting device to be used in emergency or other signaling situations. Construction options allow the lighting device to achieve good illumination efficiency for underwater use.

Figure 5:
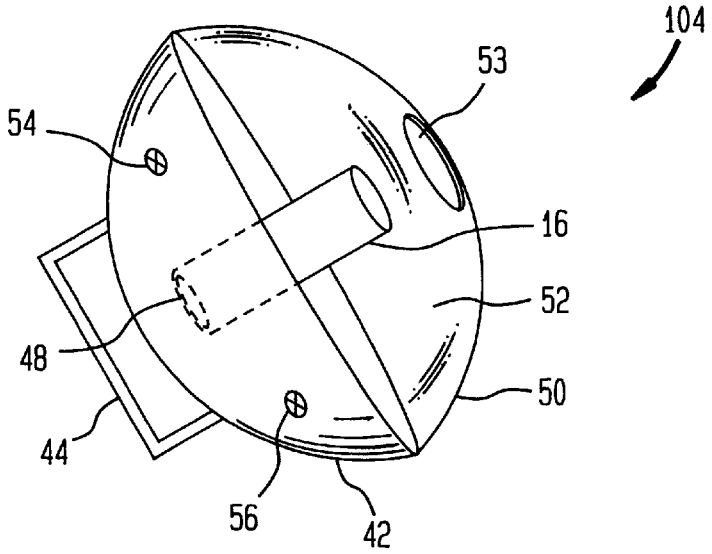
FIG. 5 is a perspective view of another embodiment of the present invention in which the light stick supporting receptacle is a portion of a sphere.

Although the invention has been described relative to a specific embodiment thereof, there are numerous variations and modifications that will be readily apparent to those skilled in the art in light of the above teachings. The shape of the light stick supporting receptacle can be other than the circular cylinder (or other parabolic cylinder) as described above. For example, FIG. 5 depicts another lighting device 104 having a receptacle 42 that is a portion of a sphere. As with previous embodiments, a handle 44 is provided and the internal surface area of receptacle 42 should be reflective. Light stick 16 is supported by a recess or socket 48 which achieves a press-fit with one end of light stick 16. A transparent cover 50 can be provided to create a sealed chamber 52 in which light stick 16 resides. Check valves 54 and 56 similar in structure and function to check valves 24 and 26, respectively, can also be provided to purge fluid from and/or evacuate sealed chamber 52. Transparent cover 52 can incorporate a spherical reflector 53 aligned coaxially with light stick 16. Spherical reflector 53 is used to increase optical efficiency by reflecting light emitted by light stick 16 that was not transmitted from the focal point of the reflective internal surface area of receptacle 42. Light that would have escaped as diverging rays can thus be reflected to the internal surface area of receptacle 42 for proper focusing. Although not shown, it is to be further understood that a transparent receptacle (similar to transparent receptacle 30) can be provided to house light stick 16 in order to provide a smaller volume to be purged of water. It is therefore to be understood that, within the scope of the appended claims, the invention may be practiced other than as specifically described.

What is claimed as new and desired to be secured by Letters Patent of the United States is:

1. A lighting device comprising:

at least one light-transmissive receptacle containing chemicals that generate illumination upon initiation of a reaction within said light-transmissive receptacle, wherein said illumination is transmitted from said light-transmissive receptacle;

a hand-held receptacle for supporting said at least one light-transmissive receptacle, said hand-held receptacle having internal surface area that is reflective and having an opening formed therein wherein, when said at least one light-transmissive receptacle is initiated and supported by said hand-held receptacle, said illumination is transmitted therefrom via said opening; and a transparent receptacle supported in said hand-held receptacle and sealed with respect to said sealed chamber, said transparent receptacle having an access accessible from the exterior of said hand-held receptacle for receiving said at least one light-transmissive receptacle therethrough wherein said at least one light-transmissive receptacle is housed in said transparent receptacle.

2. A lighting device as in claim 1, wherein said transparent cover incorporates an optical element having a focal plane with said sealed chamber.

3. A lighting device as in claim 2, wherein said at least one light-transmissive receptacle is positioned at approximately said focal plane.

4. A lighting de ice as in claim 1 further comprising a check valve cooperating with said sealed chamber.

5. A lighting device as in claim 1, wherein said internal surface area is white in color.

6. A lighting device as in claim 1, wherein said internal surface area is silver in color.

7. A lighting device as in claim 1, wherein at least a portion of said internal surface area is parabolic.

8. A lighting device as in claim 1, wherein said internal surface area is defined by a portion of a sphere.

9. A lighting device as in claim 1, wherein said sealed chamber is in a vacuum state.

10. A lighting device as in claim 1, wherein said sealed chamber is in a vacuum state.

11. A lighting device as in claim 1 further comprising a first valve cooperating between said transparent receptacle and the exterior of said hand-held receptacle for facilitating expulsion of fluid from said transparent receptacle.

12. A lighting device as in claim 11, further comprising a second valve cooperating between said transparent receptacle and the exterior of said hand-held receptacle, wherein a gas can be pumped into said sealed chamber via said second valve.

13. A lighting device as in claim 1 wherein said hand-held receptacle is formed as approximately one-half of a right circular cylinder.

14. A lighting device comprising:

at least one light-transmissive elastic cylinder having chemicals sealed therein that generate illumination upon bending of said elastic cylinder, wherein said illumination is transmitted radially from said elastic cylinder; and a hand-held receptacle constructed of non-magnetic material having at least one end cap configured to support at least one end of said at least one elastic cylinder, said hand-held receptacle having internal surface area that is reflective and having an opening formed therein wherein, when said at least one elastic cylinder is transmitting said illumination and supported by said end cap, said illumination is transmitted therefrom via said opening.

15. A lighting device as in claim 14, further comprising a transparent cover sealing said opening, wherein a sealed chamber is formed within the confines of said hand-held receptacle and said transparent cover.

16. A lighting device as in claim 15 further comprising a first valve cooperating with said sealed chamber, wherein fluid can be expelled from said sealed chamber via said first valve.

17. A lighting device as in claim 16, further comprising a second valve cooperating with said sealed chamber, wherein a gas can be pumped into said sealed chamber via said second valve.

18. A lighting device as in claim 14, wherein said internal surface area is white in color.

19. A lighting device as in claim 18 wherein said hand-held receptacle is constructed from polyvinyl chloride (PVC) that is white in color.

20. A lighting device as in claim 21, wherein at least a portion of said internal surface area is parabolic.

21. A lighting device comprising:

at least one light-transmissive elastic cylinder having chemicals sealed therein that generate illumination upon bending of said elastic cylinder, wherein said illumination is transmitted radially from said elastic cylinder;

a hand-held receptacle constructed of non-magnetic material for supporting at least one end of said at least one elastic cylinder, said hand-held receptacle having internal surface area that is reflective and having an opening formed therein wherein, when said at least one elastic cylinder is transmitting said illumination and supported by said hand-held receptacle, said illumination is transmitted therefrom via said opening;

a transparent cover sealing said opening, wherein a sealed chamber is formed within the confines of said hand-held receptacle and said transparent cover; and a transparent receptacle supported in said hand-held receptacle and sealed with respect to said sealed chamber, said transparent receptacle having an access accessible from the exterior of said hand-held receptacle for receiving said at least one elastic cylinder therethrough wherein said elastic cylinder is housed in said transparent receptacle.

22. A lighting device as in claim 21, wherein said transparent cover incorporates an optical element having a focal plane within said sealed chamber.

23. A lighting device as in claim 22, wherein said at least one light-transmissive receptacle is positioned at approximately said focal plane.

24. A lighting device as in claim 21, wherein said sealed chamber is in a vacuum state.

25. A lighting device as in claim 21 further comprising a first valve cooperating between said transparent receptacle and the exterior of said hand-held receptacle for facilitating expulsion of fluid from said transparent receptacle.

26. A lighting device as in claim 25, further comprising a second valve cooperating between said transparent receptacle and the exterior of said hand-held receptacle, wherein a gas can be pumped into said sealed chamber via said second valve.

27. A lighting device as in claim 21 wherein said hand-held receptacle is formed as approximately one-half of a right circular cylinder.

* * * * *